United States Patent [19]

Baesgen et al.

[11] 4,307,587

[45] Dec. 29, 1981

[54] KNITTED FABRIC WITH A NEW PATTERN AND A PROCESS FOR ITS PRODUCTION

[75] Inventors: Harald Baesgen; Helmut Schillings, both of Dormagen, Fed. Rep. of Germany

[73] Assignee: Bayer Aktiengesellschaft, Leverkusen, Fed. Rep. of Germany

[21] Appl. No.: 851,743

[22] Filed: Nov. 15, 1977

[30] Foreign Application Priority Data

Nov. 24, 1976 [DE] Fed. Rep. of Germany ..... 2653417

[51] Int. Cl.[2] ..... D04B 21/00

[52] U.S. Cl. ..... 66/195; 66/202

[58] Field of Search ..... 66/192–195, 66/202

[56] References Cited

U.S. PATENT DOCUMENTS

| | | | |
|---|---|---|---|
| 2,012,355 | 8/1935 | Schonfeld | 66/192 X |
| 2,706,898 | 4/1955 | Gross et al. | 66/193 |
| 3,390,549 | 7/1968 | Brand | 66/192 |
| 3,931,721 | 1/1976 | Adamson | 66/195 |

*Primary Examiner*—Ronald Feldbaum

*Attorney, Agent, or Firm*—Sprung, Felfe, Horn, Lynch & Kramer

[57] ABSTRACT

The invention is related to elastic warp knitted articles comprising as warp threads elastic yarns which have been formed into three or more adjacent stitches in one course.

5 Claims, 11 Drawing Figures

KNITTED FABRIC WITH A NEW PATTERN AND A PROCESS FOR ITS PRODUCTION

Figure 1:
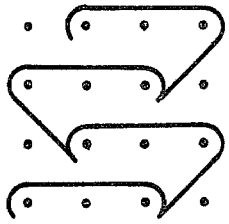

Sheet-form fabrics of two interlacing groups and their combinations with one another are produced from fibre and filament yarns on warp-knitting machines. These interlacing groups differ from one another in that, in one case, the warp threads are placed (over a knitting needle) to form a single stitch and the underlaps can be combined in numerous variants. Such fabrics as charmeuse (two-thread system), plain/pearl tricot cloth, plain/pearl satin tricot and plain/pearl fringe satin, are made in this way.

In the other case, the warp threads are interlaced (through two adjacent knitting needles) to form a double stitch using the single-thread or double-thread system. Patterns formed by placing warp threads over two knitting needles are known as two-needle fringes or twills, both open and also closed.

Bi-elastic fabrics knitted with elastic polyurethane filament yarns are also known. In their case, patterns are produced either using only one elastic polyurethane filament system (warp beam) or using more than one elastic polyurethane filament system at a time.

A warp thread system, whether laid in the weft, in single stitches or in double stitches (formed by laying over one or two needles) is known to lend itself to such designs as powerstretch (two elastic polyurethane filament system) and satinstretch (one elastic polyurethane filament system) for use in corsetry, and charmeuse or twill and the like for use in swimwear. In these known patterns, however, the elastic properties differ considerably in the longitudinal and transverse directions (for example powerstretch with an elasticity of about 120% in the longitudinal direction and about 70% in the transverse direction.

In order to adapt the longitudinal and transverse properties of the fabric, it is now standard practice to use elastic polyurethane filament yarn as warp thread not only in single and double thread systems, but also in double thread systems of which one elastic polyurethane thread system consists of weft threads.

For example, there are articles produced with two elastic polyurethane thread systems of which one elastic polyurethane thread system is controlled by relatively large weft underlaps (for example below three needles) and the second elastic polyurethane thread system is controlled by a single weft underlap below one needle.

In another known method, elastic polyurethane weft threads are introduced in addition to an elastic polyurethane warp beam. Articles produced by such a method are made on specially designed machines in which the weft threads are introduced over the entire width of the machine. Elastic polyurethane filament yarns with a thickness of greater than about 120 dtex are normally used in both warp and weft.

However, the interlacing of warp threads by way of up to two adjacent needles using the techniques described above limits the range of potential patterns in cases where it is desired to produce a coherent sheet-form textile article. For example, it is not possible to produce a sheet-form textile material corresponding to the gauge of the machine using the single-thread system with a threading pattern on the guide bar of one full and one empty and with the threads placed over one needle. Neither is it possible to produce a sheet-form textile corresponding to the gauge of the machine using the single-thread system with a threading pattern of one full and two empty and with the threads placed over two adjacent needles.

Articles produced by the known lapping technique, that is overlaps of one and even two needles, using several thread systems, of which only one consists of elastic polyurethane filament yarn, are attended by the disadvantage of variable elasticity and force absorption when drawn in the longitudinal and transverse direction.

This disadvantage can be obviated, for example, by introducing a second elastic polyurethane filament system which is laid in either as partial weft or complete weft. Unfortunately, this involves another disadvantage, i.e. in articles having a complete weft of elastic polyurethane filament yarn, the elastic polyurethane filaments tend to withdraw from the stitch structure of the non-elastic polyurethane filaments used and are displaced under significant loads. This calls for a special finish in the form of a heat treatment which in turn is accompanied by certain disadvantages, for example in regard to the forming forces.

Although, in the case of articles with two elastic polyurethane filament systems, of which one is incorporated as partial weft below several needles, it is not absolutely essential to provide a non-slip finish such as this, and although in their case the danger of dropping out, particularly in and around the seams, is reduced in relation to qualities having a complete weft of elastic polyurethane, it is nevertheless not completely eliminated because the elasthane filaments are not used for stitch formation. Another consequence of this technique is a considerably poorer hysteresis in the transverse direction. It is an object of this invention to avoid the disadvantages mentioned above. Other objects will be evident from the following description and the Examples.

It has now been found that the disadvantages referred to above can be obviated by forming stitches with elastic yarns over three or more, preferably three or four, adjacent knitting needles on a warp knitting machine.

The invention relates to an elastic warp knitted article, which comprises as warp threads elastic yarns which have been formed into three or more adjacent stitches in one course and which are fully drawn-in in the case of three adjacent stitches.

The invention also relates to a process for producing an elastic warp knitted article, wherein elastic yarns drawn in as warp threads form stitches over three or more adjacent knitting needles in one course and which are fully drawn-in in the case of three adjacent stitches.

According to the present invention, the stitches are preferably formed over three or four adjacent knitting needles. This stitch pattern is completely new and has hitherto been considered among experts to be impracticable.

In the context of the present invention, elastic yarns are preferably elastic polyurethane yarns, i.e. yarns of elastic polyurethane filaments, although it is also possible to use elastic yarns of non-stretch fibres or filaments, for example textured yarns, providing they have a minimal elongation at break of around 15% (as measured by the crimp contraction method described in DIN 53 840).

In order to obtain the lowest possible fabric weights, coupled with a high forming force, it is preferred to use fine elastic polyurethane deniers, for example, preferably 22 dtex, 45 dtex or 80 dtex elastic polyurethane filament yarn.

If thicker elastic polyurethane filaments, such as dtex 160, are used (in which case raschel knitting machines are preferably used), sheet-form fabrics with extremely high, elastic forces are obtained with the result that the use of even thicker elastic polyurethane yarns, for example with deniers of more than 480 dtex would appear to be inappropriate.

The textured elastic yarns which may be used instead of the elastic polyurethane yarns may have deniers of up to about 200 dtex.

It is of course possible to process together with the elastic yarn a substantially non-elastic fibre yarn or filament yarn of synthetic or natural fibres or filaments. Yarns such as these best have deniers in the range from 10 dtex to 200 dtex.

Figure 2:
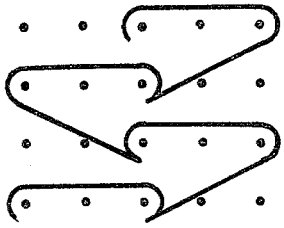
Figure 3:
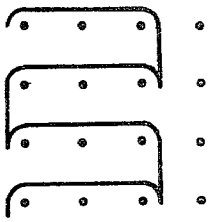
Figure 4:
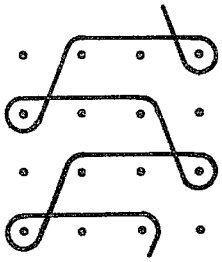
Figure 5:
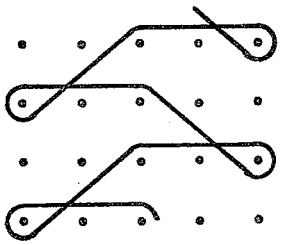

FIGS. 1 to 6 of the accompanying drawings show examples of interlacing possibilities of how an "over three" pattern can be obtained, as follows:

FIG. 1: "over 3"—"under 1" needle/open stitches;

FIG. 2: "over 3"—"under 2" needles/open stitches;

FIG. 3: "over 3"—needles/open stitches;

FIG. 4: "over 3"—under 1" needle/closed reverse course;

FIG. 5: "over 3"—"under 2" needles/closed reverse course; and

Figure 6:
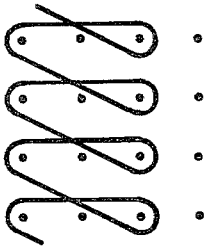

FIG. 6: "over 3"—needles stitch open at one end with an open reverse course.

Figure 7:
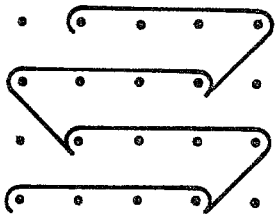
Figure 8:
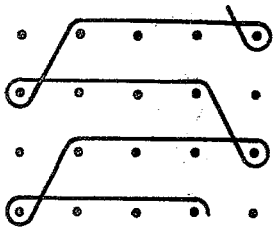
Figure 9:
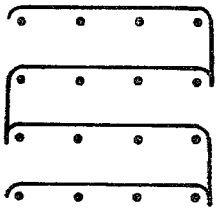

FIGS. 7 to 9 show examples of different methods of interlacing for "over 4 needles", as follows:

FIG. 7: "over 4"—"under 1" needle/open stitches;

FIG. 8: "over 4"—"under 1" needle/closed reverse course; and

FIG. 9; "over 4"—needles/open stitches.

Figure 10:
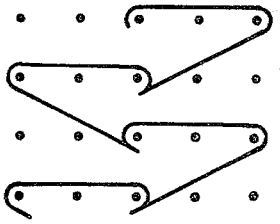
Figure 11:
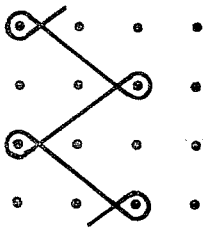

FIGS. 10 and 11 illustrate the interlacing plan on which Example 1 is based (FIG. 10 for guide bar I; FIG. 11 for guide bar II).

The advantages obtainable in accordance with the invention differ according to how elastic polyurethane filament yarn or other textured synthetic yarns are used for the described stitch formation over three or more adjacent needles.

Where elastic polyurethane filaments are used, the article obtained has substantially the same elasticity in both directions (longitudinal and transverse).

The particular advantage which this article has over articles with weft inlay is that elastic polyurethane containing articles according to the present invention do not have to be provided with a non-slip finish by an additional heat treatment because, by virtue of the way in which they are interlaced (stitch formation with elastic polyurethane filaments), they are completely slip-proof and, for this reason, do not give rise to any sewing problems at the making-up stage.

Another advantage is that, where fine elastic polyurethane filaments e.g. 22 dtex and 45 dtex, are used, giving articles of corresponding, fine character, the elastic forces obtained when these fine articles are stretched are comparable with those of articles having three or four times the elastic polyurethane denier coupled with equally high elasticity.

In addition, it is possible by interlacing "over 3 needles" to form a coherent sheet-form textile corresponding to the gauge of the machine even when yarns are threaded on a guide bar in the repeat pattern of one full and two empty. With interlacing "over 4 needles", it is even possible to produce similar sheet-form textiles with a repeat pattern of one full and three empty.

Accordingly, the range of potential patterns in warp knitting is quite considerably extended in this way.

Whereas articles knitted in conventional patterns using the single-thread system and fine machine gauges are labile and meagre and show a marked tendency towards laddering, an article produced in accordance with the present invention using the single-thread system is stable, closed and ladderproof. In order to obtain these properties, it has hitherto been necessary to use at least two thread systems.

Where it contains elastic polyurethane filament yarn, the new knitted article is particularly suitable for use in girdles, underwear, swimwear and sports clothing, whereas, where the knitted article contains elastic textured yarns, it is particularly suitable for lightweight women's outer clothing with a novel fabric character.

The following Examples are to further illustrate the invention without limiting it.

EXAMPLE 1

A knitted article was produced in accordance with the following technical specification on an automatic R/L-flat warp knitting machine with two guide bars in a gauge of 28 E, 84 " working width:

Material:

GB I 45 dtex elastic polyurethane filament yarn

GB II 44 dtex f 12 polyamide-6-filament yarn.

Lapping:

GB I 0-3-4/5-2-1//,

GB II 2-3-2/1-0-1//.

Drawing-in:

GB I and

GB II full drawing-in.

The lapping of the article corresponds to FIGS. 10 and 11.

In order to enable the machine to work smoothly, the needle bar had to be set about 0.4 mm higher.

A fabric containing 40 courses per cm and 25 wales per cm is obtained, its width amounting to 90 cm and its weight per square meter to 317 g. The proportion by weight of elastic polyurethane amounts to 48%.

The properties of the fabric are set out in the following Table:

| | | Longitudinal direction/transverse direction | |
|---|---|---|---|
| Elongation at break under a sample load of 5 N/cm sample width | | 98.3 | 99.5 |
| Maximum sample elongation (%) | | 90 | 90 |
| Power absorption (N) of the sample at maximum elongation | 1st elongation cycle | 4.49 | 3.88 |
| | 2nd elongation cycle | 4.24 | 3.69 |
| | 5th elongation cycle | 3.99 | 3.51 |
| Power absorption (N) of the sample at half maximum elongation | 1st elongation cycle | 2.11 | 1.67 |
| | 2nd elongation cycle | 1.47 | 1.21 |
| | 5th elongation cycle | 1.36 | 1.14 |
| Power absorption of the sample (N) | | | |

-continued

| | Longitudinal direction/transverse direction | |
|---|---|---|
| at half maximum elongation (relaxation curve) in the 5th elongation cycle | 1.02 | 0.89 |
| Power absorption of the sample at the beginning of relaxation $P_R$ (N) and maximum elongation | 3.99 | 3.52 |
| Power absorption of the sample after 5 minutes relaxation: $P_R$ 5 (N) at maximum elongation | 3.20 | 2.77 |
| Residual elongation (%) | 0 | 0 |
| Ratio $B_1$ (power absorption from the 5th to the 1st elongation cycle at maximum sample elongation) | 0.89 | 0.90 |
| Ratio $B_2$ (power absorption from the 5th to the 1st elongation cycle at half maximum sample elongation) | 0.65 | 0.68 |
| Ratio $B_3$ (power absorption of the relaxation curve to the load curve in the 5th elongation cycle at half maximum elongation) | 0.75 | 0.79 |
| Relaxation ratio R ($P_R5$:$P_R$) | 0.80 | 0.79 |
| Ratio $C_1$ (power absorption from the 5th elongation cycle at half maximum elongation to the 5th elongation cycle at maximum elongation) | 0.34 | 0.32 |

EXAMPLE 2

A knitted article was produced in accordance with the following technical specification on an automatic R/L flat warp knitting machine with one guide bar and a gauge of 28 E:

Material: GB I: 44 dtex f 10 perlon filament yarn, textured.

Lapping: GB I: 0-3-4/5-2-1//.

Weight of finished article: 150 g/m$^2$.

The lapping corresponds to FIG. 11.

We claim:

1. An elastic warp knitted article formed by one, or more, fully threaded guide bars of elastic yarns which have been knitted into at least three immediately adjacent stitches in one course.

2. The article of claim 1, wherein said elastic yarn is an elastic polyurethane yarn.

3. The article of claim 1, wherein said elastic yarns have been formed into three or four adjacent stitches in one course.

4. A process for producing an elastic warp knitted article with a fully threaded guide bar of elastic yarns which comprises feeding said yarns to at least three immediately adjacent needles on a warp knitting machine to form at least three immediately adjacent connected stitches in one course.

5. The process of claim 4, wherein the stitches are formed over three or four adjacent knitting needles in one course.

* * * * *